US008757128B2

(12) United States Patent
Fischer et al.

(10) Patent No.: US 8,757,128 B2
(45) Date of Patent: Jun. 24, 2014

(54) DECOUPLING ELEMENT FOR A FUEL INJECTION DEVICE

(75) Inventors: Michael Fischer, Niefern-Oeschelbronn (DE); Friedrich Moser, Magstadt (DE); Markus Friedrich, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 848 days.

(21) Appl. No.: 12/737,196

(22) PCT Filed: Apr. 28, 2009

(86) PCT No.: PCT/EP2009/055141

§ 371 (c)(1), (2), (4) Date: Mar. 17, 2011

(87) PCT Pub. No.: WO2009/156219

PCT Pub. Date: Dec. 30, 2009

(65) Prior Publication Data

US 2011/0155824 A1 Jun. 30, 2011

(30) Foreign Application Priority Data

Jun. 26, 2008 (DE) ..... 10 2008 002 654

(51) Int. Cl.

| | |
|---|---|
| ***F02M 61/14*** | (2006.01) |
| *F02M 61/00* | (2006.01) |
| *F02M 61/16* | (2006.01) |

(52) U.S. Cl.

USPC ..... 123/294; 123/470

(58) Field of Classification Search

CPC . F02M 61/14; F02M 55/025; F02M 2200/85; F02M 2200/858

USPC ..... 123/294, 456, 445, 470, 469, 193.3; 239/533.2, 533.9; 137/315.11, 315.31, 137/316

See application file for complete search history.

(56) References Cited

U.S. PATENT DOCUMENTS

| | | | | |
|---|---|---|---|---|
| 6,009,856 | A | 1/2000 | Smith, III et al. | |
| 6,318,341 | B1 * | 11/2001 | Gmelin et al. | 123/470 |
| 6,553,969 | B1 * | 4/2003 | Hans et al. | 123/470 |
| 7,293,550 | B2 * | 11/2007 | Beardmore | 123/470 |
| 2007/0175451 | A1 | 8/2007 | Beardmore | |

FOREIGN PATENT DOCUMENTS

| | | | | |
|---|---|---|---|---|
| DE | 100 27 662 | | 12/2001 | |
| DE | 100 38 763 | | 2/2002 | |
| DE | 101 08 466 | | 9/2002 | |
| DE | 10 2007 004 086 | | 8/2007 | |
| EP | 1 223 337 | | 7/2002 | |
| JP | 10-61527 | | 3/1998 | |
| JP | 11-210886 | | 8/1999 | |
| JP | 2006046224 | A * | 2/2006 | F02M 61/14 |
| JP | 2006-513370 | | 4/2006 | |
| WO | WO 02/066822 | | 8/2002 | |
| WO | WO 2005/021956 | | 3/2005 | |

* cited by examiner

*Primary Examiner* — Hieu T Vo

(74) *Attorney, Agent, or Firm* — Kenyon & Kenyon LLP

(57) ABSTRACT

A fuel injection device includes at least one fuel injector, one mounting hole in a cylinder head for the fuel injector, and a decoupling element between a valve housing of the fuel injector and the wall of the mounting hole. As a lenticular spring element, the decoupling element has a nonlinear, progressive spring characteristic curve, such that a low rigidity of the decoupling element prevails during idle operation and a high rigidity of the decoupling element prevails during nominal system pressure.

12 Claims, 4 Drawing Sheets

DECOUPLING ELEMENT FOR A FUEL INJECTION DEVICE

BACKGROUND OF THE INVENTION

1. Field of the Invention

The present invention is directed to a decoupling element for a fuel injection device.

2. Description of Related Art

A fuel injection device known from the related art is shown as an example in FIG. 1, in which a flat intermediate element is provided on a fuel injector, which is installed in a mounting hole of a cylinder head of an internal combustion engine. Such intermediate elements having the shape of a flat washer are placed as support elements on the shoulder of the mounting hole of the cylinder head in a known way. With the aid of such intermediate elements, manufacturing and installation tolerances are compensated for and a mounting free of lateral forces is ensured even if the fuel injector is slightly inclined. The fuel injection device is suitable in particular for use in fuel injection systems of mixture-compressing, external-ignition internal combustion engines.

Another type of a simple intermediate element for a fuel injection device is already known from published German patent document DE 101 08 466 A1. The intermediate element is a washer having a circular cross section, which is situated in an area in which both the fuel injector and the wall of the mounting hole in the cylinder head run in the shape of a truncated cone and is used as a compensation element for the mounting and support of the fuel injector.

More complicated intermediate elements for fuel injection devices, which are significantly more complex to manufacture, are also known, inter alia, from published German patent document DE 100 27 662 A1, published German patent document DE 100 38 763 A1, and published European patent document EP 1 223 337 A1. These intermediate elements are distinguished in that they all have multipart or multilayer constructions and are to partially take over sealing and damping functions. The intermediate element known from published German patent document DE 100 27 662 A1 includes a main body and a carrier body, in which a sealing means is inserted, which is penetrated by a nozzle body of the fuel injector. A multilayer compensation element is known from published German patent document DE 100 38 763 A1, which is composed of two rigid rings and an elastic intermediate ring sandwiched between them. This compensation element allows both tilting of the fuel injector to the axis of the mounting hole across a relatively large angular range and a radial displacement of the fuel injector out of the central axis of the mounting hole.

An intermediate element which is also multilayered is also known from published European patent document EP 1 223 337 A1, this intermediate element being assembled from multiple flat washers, which are made of a damping material. The damping material made of metal, rubber, or PTFE is selected and designed in such a way that noise damping of the vibrations and noises generated by the operation of the fuel injector is made possible. The intermediate element must include four to six layers for this purpose, however, in order to achieve an intended damping effect.

To reduce noise emissions, U.S. Pat. No. 6,009,856 additionally proposes to enclose the fuel injector using a sleeve and to fill the resulting intermediate space with an elastic, noise-damping compound. This type of noise damping is very complex, difficult to install, and expensive, however.

BRIEF SUMMARY OF THE INVENTION

The decoupling element for a fuel injection device according to the present invention has the advantage that improved noise reduction is achieved by insulation in a very simple construction. According to the present invention, the decoupling element has a nonlinear, progressive spring characteristic curve, through which multiple positive and advantageous aspects result in the installation of the decoupling element in a fuel injection device having injectors for direct fuel injection. The low rigidity of the decoupling element at the idle point allows effective decoupling of the fuel injector from the cylinder head and thus significantly reduces the structure-borne noise power introduced into the cylinder head in noise-critical idle operation and therefore the noise emitted from the cylinder head. The high rigidity at nominal system pressure causes little overall movement of the fuel injector during vehicle operation and thus ensures, on the one hand, the durability of the sealing rings, which are used as the combustion chamber seal and as the seal in relation to the fuel rail, and, on the other hand, a stable point of injection of the fuel spray into the combustion chamber, which is decisive for the stability of some combustion methods.

The spring characteristic curve of the decoupling element according to the present invention may advantageously have a progressive targeted design by adapting the geometric parameters (unrolling radii $R_1$ and $R_2$, contact diameters in the non-deformed state $D_1$ and $D_2$, component height $H_1$). The decoupling element is distinguished by a low overall height, whereby it is also usable similarly to a disc spring in a small installation space. The decoupling element additionally has great fatigue strength, even at high temperatures. Both the design calculation and the manufacture are easily possible for the decoupling element as a rotationally symmetric component.

It is particularly advantageous to be able to use the decoupling element in two installation locations. On the one hand, the installation of the decoupling element is possible in such a way that the upper delimitation surface of the decoupling element presses against the valve housing of the fuel injector in a small-diameter area having a contact diameter $D_1$ in the non-deformed state, while the lower delimitation surface of the decoupling element contacts the mounting hole in a large-diameter area having a contact diameter $D_2$. On the other hand, the same decoupling element may also be installed in such a way that the upper delimitation surface of the decoupling element presses against the valve housing of the fuel injector in a large-diameter area having a contact diameter $D_1$ in the non-deformed state, while the lower delimitation surface of the decoupling element contacts the mounting hole in a small-diameter area having a contact diameter $D_2$.

DETAILED DESCRIPTION OF THE INVENTION

Figure 1:
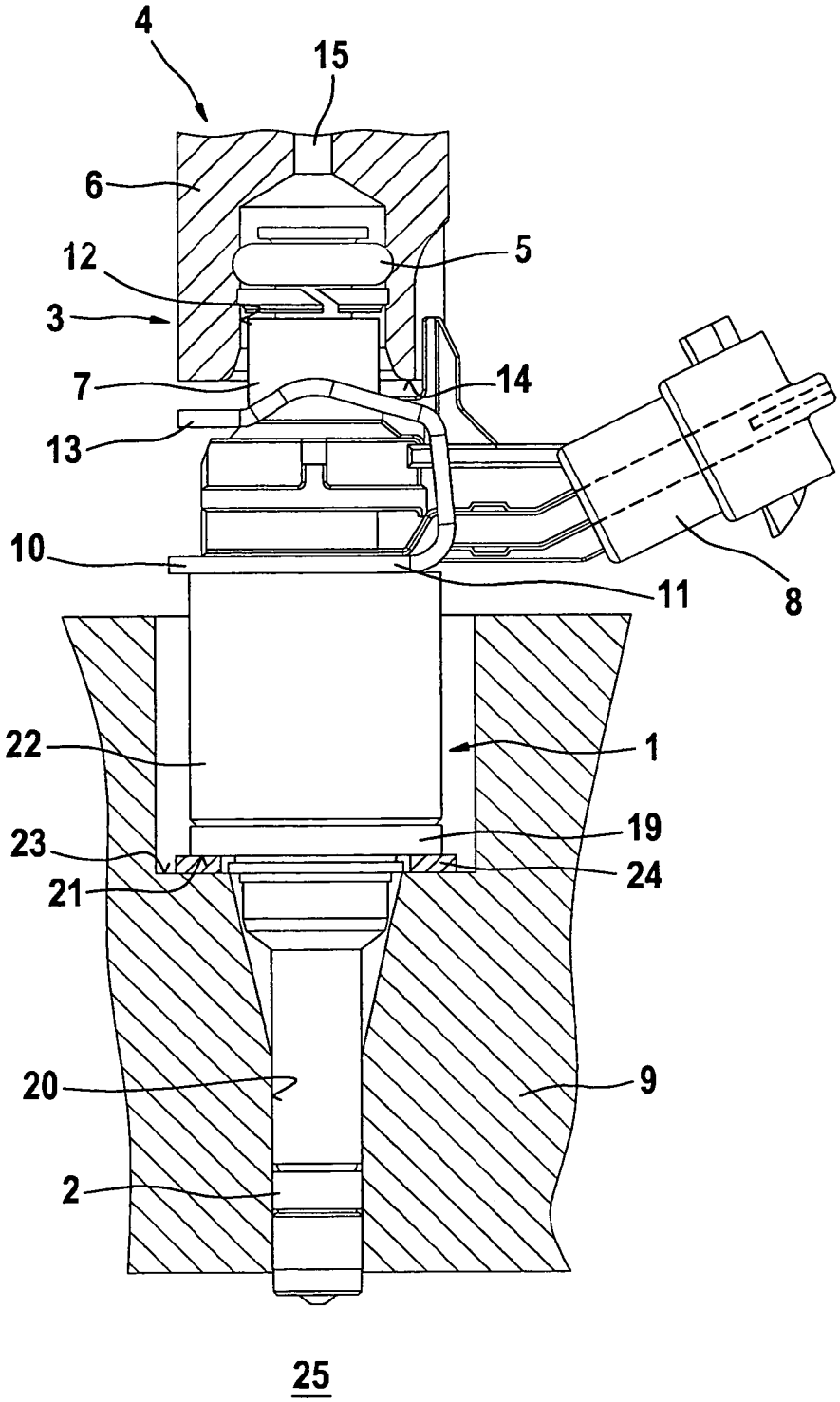
FIG. 1 shows a partially illustrated known fuel injection device having a disc-shaped intermediate element.

A known embodiment of a fuel injection device is described in greater detail hereafter on the basis of FIG. 1 for better understanding of the present invention. A valve having the shape of a fuel injector 1 for fuel injection systems of mixture-compressing, external-ignition internal combustion engines is shown in a side view in FIG. 1 as an exemplary embodiment. Fuel injector 1 is part of the fuel injection device. A downstream end of fuel injector 1, which is designed as a direct injection injector for the direct injection of fuel into a combustion chamber 25 of the internal combustion engine, is installed in a mounting hole 20 of a cylinder head 9. A sealing ring 2, in particular made of Teflon®, ensures an optimum seal of fuel injector 1 in relation to the wall of mounting hole 20 of cylinder head 9.

A flat intermediate element 24, which is designed as a flat washer, is placed between a projection 21 of a valve housing 22 (not shown) or a lower front side 21 of a support element 19 (FIG. 1) and a shoulder 23 of mounting hole 20, which runs perpendicular to the longitudinal extension of mounting hole 20, for example. With the aid of such an intermediate element 24 or together with a rigid support element 19, which has a contact surface curved inward toward fuel injector 1, for example, manufacturing and installation tolerances are compensated for and mounting free of lateral force is ensured even if fuel injector 1 is slightly inclined.

On its inflow end 3, fuel injector 1 has a plug connection to a fuel rail 4, which is sealed via a sealing ring 5 between a connecting piece 6 of fuel rail 4, which is shown in section, and an inflow connecting piece 7 of fuel injector 1. Fuel injector 1 is inserted into a receptacle opening 12 of connecting piece 6 of fuel rail 4. Connecting piece 6 originates in one piece from actual fuel rail 4, for example, and has a smaller-diameter flow opening 15 upstream from receptacle opening 12, via which the flow against fuel injector 1 occurs. Fuel injector 1 has an electrical connection plug 8 for the electrical contact to actuate fuel injector 1.

In order to space fuel injector 1 and fuel rail 4 apart from one another largely free of radial forces and to hold down fuel injector 1 securely in the mounting hole of the cylinder head, a hold-down device 10 is provided between fuel injector 1 and connecting piece 6. Hold-down device 10 is designed as a U-shaped component, for example as a stamped-bent part. Hold-down device 10 has a main element 11 having the shape of a partial ring, from which a hold-down bow 13 is bent over, which presses against a downstream end face 14 of connecting piece 6 on fuel rail 4 in the installed state.

The object of the present invention is to achieve improved noise reduction in a simple way, above all during the noise-critical idle operation, through a targeted design and geometry of intermediate element 24, in contrast to the known intermediate element approaches. The decisive noise source of fuel injector 1 during direct high-pressure injection are the forces (structure-borne noise) introduced into cylinder head 9 during the valve operation, which result in a structural excitation of cylinder head 9 and are emitted therefrom as airborne noise. In order to achieve a noise improvement, a minimization of the forces introduced into cylinder head 9 is therefore to be strived for. In addition to the reduction of the forces caused by the injection, this may be achieved by influencing the transmission behavior between fuel injector 1 and cylinder head 9.

Figure 2:
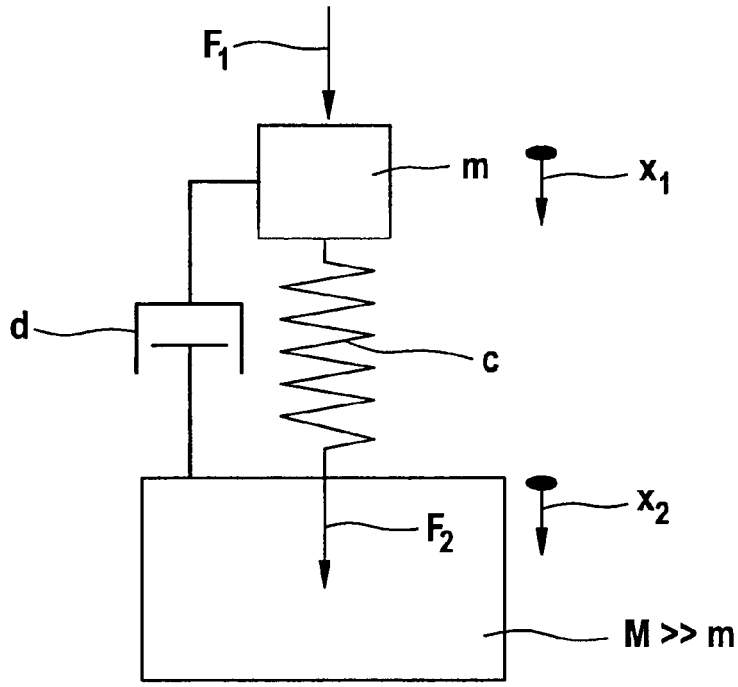
FIG. 2 shows a mechanical equivalent circuit diagram of the support of the fuel injector in the cylinder head during direct fuel injection, which represents a typical spring-mass-damper system.
Figure 3:
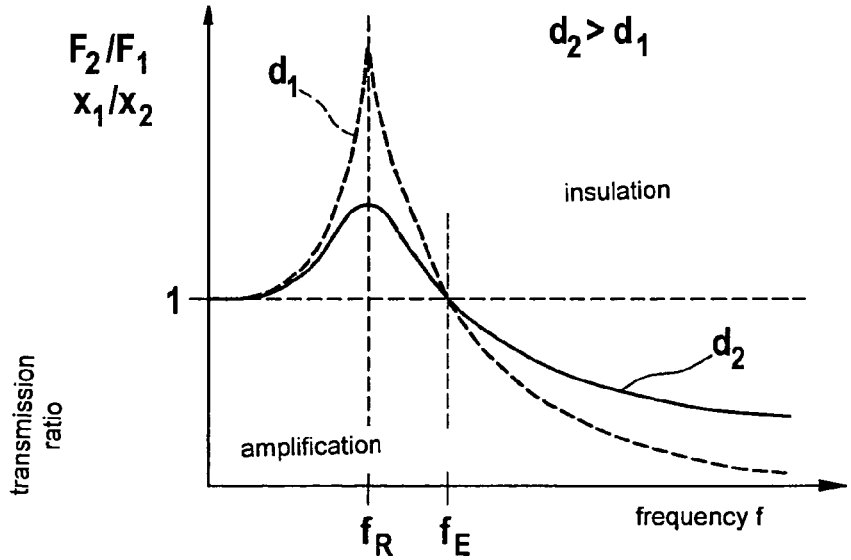
FIG. 3 shows the transmission behavior of a spring-mass-damper system shown in FIG. 2 having an amplification at lower frequencies in the range of resonant frequency $f_R$ and an insulation range above decoupling frequency $f_E$.

In the mechanical meaning, the mounting of fuel injector 1 on passive intermediate element 24 in mounting hole 20 of cylinder head 9 may be modeled as a typical spring-mass-damper system, as shown in FIG. 2. Mass M of cylinder head 9 may be assumed to be infinitely large in relation to mass m of fuel injector 1 in a first approximation. The transmission behavior of such a system is distinguished by an amplification at low frequencies in the range of resonant frequency $f_R$ and an insulation range above decoupling frequency $f_R$ (see FIG. 3).

Proceeding from this transmission behavior resulting from the spring-mass-damper system, multiple possibilities result for noise reduction:

1. Shifting the natural frequency toward lower frequencies, so that the insulation range includes the largest possible part of the audible frequency spectrum. This may be achieved via a lower rigidity c of intermediate element 24.
2. Increasing the damping properties (e.g., friction) of intermediate element 24, in order to attenuate the amplification at low frequencies. However, the insulation effect is also reduced in the higher frequency ranges with higher damping properties.
3. A combination of the two above-mentioned possibilities.

The goal of the present invention is the design of an intermediate element 24 with the primary use of the elastic insulation (decoupling) for noise reduction, in particular during idle operation of the vehicle. The present invention includes, on the one hand, the definition and design of a suitable spring characteristic curve in consideration of the typical requirements and boundary conditions during direct fuel injection at a variable operating pressure and, on the other hand, the design of an intermediate element 24, which is capable of modeling the characteristic of the thus defined spring characteristic curve and may be adapted to the specific boundary conditions of the injection system via a selection of simple geometric parameters.

Figure 4:
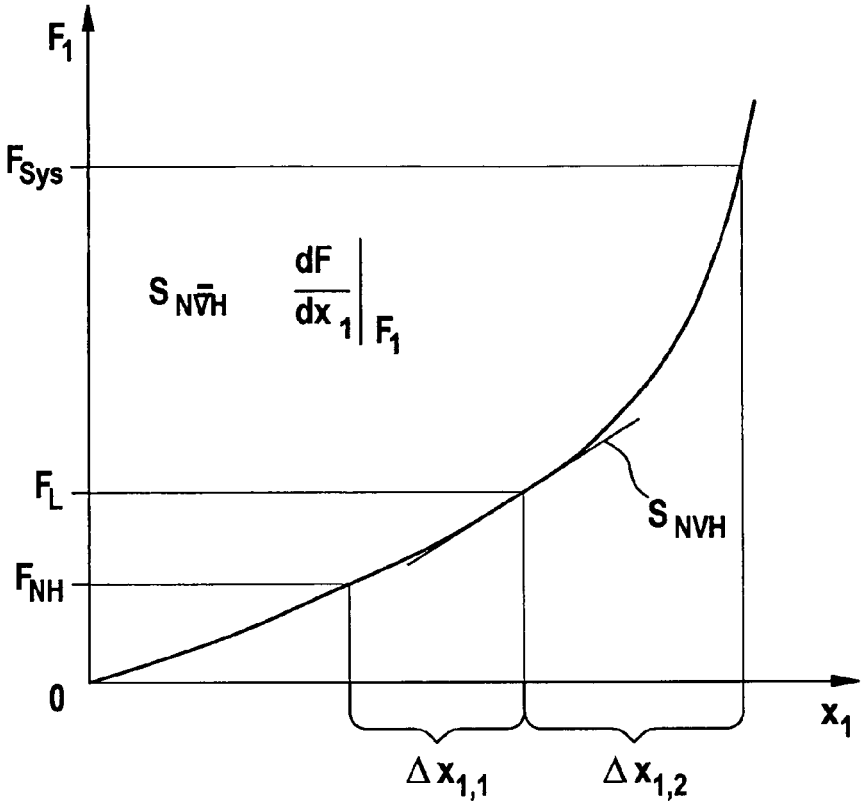
FIG. 4 shows a nonlinear, progressive spring characteristic curve to implement different rigidities as a function of the operating point, having a low rigidity $S_{NVH}$ during idle operation and a high rigidity in nominal system pressure $F_{sys}$.

The decoupling of fuel injector 1 from cylinder head 9 with the aid of low spring rigidity c of intermediate element 24, which is referred to hereafter as decoupling element 240, is made more difficult by a restriction of the permissible maximum movement of fuel injector 1 during engine operation, in addition to the small installation space. As shown in FIG. 4, the following quasi-static load states typically occur in the vehicle:

1. Static hold-down force $F_{NH}$, which is applied by a hold-down device 10 after the installation,
2. force $F_L$ prevailing during idle operation pressure, and
3. force $F_s$ prevailing during nominal system pressure.

The functional requirements for the spring characteristic curve of decoupling element 240 are:

- the least possible rigidity ($S_{NVM}$) during idle operation for noise reduction by insulation,
- maintaining a maximum permissible movement $\Delta x_{1.1}$ of fuel injector 1 during the engine start,
- maintaining a maximum permissible movement $\Delta x_{1.2}$ of fuel injector 1 during vehicle operation between idle operational pressure and nominal system pressure.

The restriction of the movement of fuel injector 1 in the two latter points is necessary to allow the function of sealing ring 2 and the O-ring seal having sealing ring 5 over the entire service life of the vehicle. For this purpose, the restriction of the movement of fuel injector 1 between idle pressure and system pressure is critical in particular, because a high rigidity of decoupling element 240 is required due to the relative large force difference.

Typical support elements as intermediate elements 24 have a linear spring characteristic curve in the described force range. This has the result that the rigidity of intermediate element 24 in the intended decoupling point during the case of idle operation must be oriented to the above-defined, maximum permissible movement of fuel injector 1 and is too great for effective decoupling. Because the nominal operating pressures will presumably rise further in the future, this problem will be further amplified.

In order to solve this conflict, according to the present invention a nonlinear spring characteristic curve having a progressive curve is proposed for decoupling element 240, as outlined in FIG. 4. The characteristic of this spring characteristic curve allows noise decoupling with the aid of a low spring rigidity ($S_{NVH}$) during idle operation and allows the maximum movement of fuel injector 1 to be maintained between idle and system pressure through the rapidly rising rigidity.

To be able to implement the nonlinear spring characteristic curve easily and cost-effectively during typical boundary conditions of direct fuel injection (small installation space, large forces, slight total movement of fuel injector 1), decoupling element 240 is designed similarly to a disc spring according to the present invention, which produces a clearly progressive spring characteristic curve due to the special geometric design of its cross-sectional geometry. It thus differs significantly from typical disc springs, which fundamentally initially only have a linear or degressive characteristic curve. With typical disc springs, a progressive curve is only achieved when they are loaded nearly completely to "block."

Figure 5:
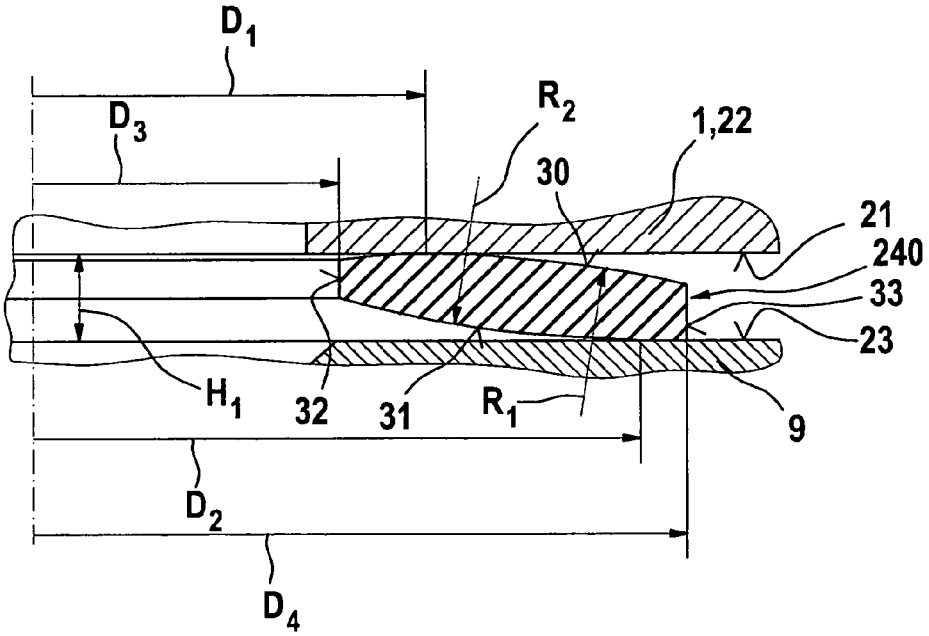
FIG. 5 shows a partial cross section through a first embodiment of a decoupling element according to the present invention.
Figure 6:
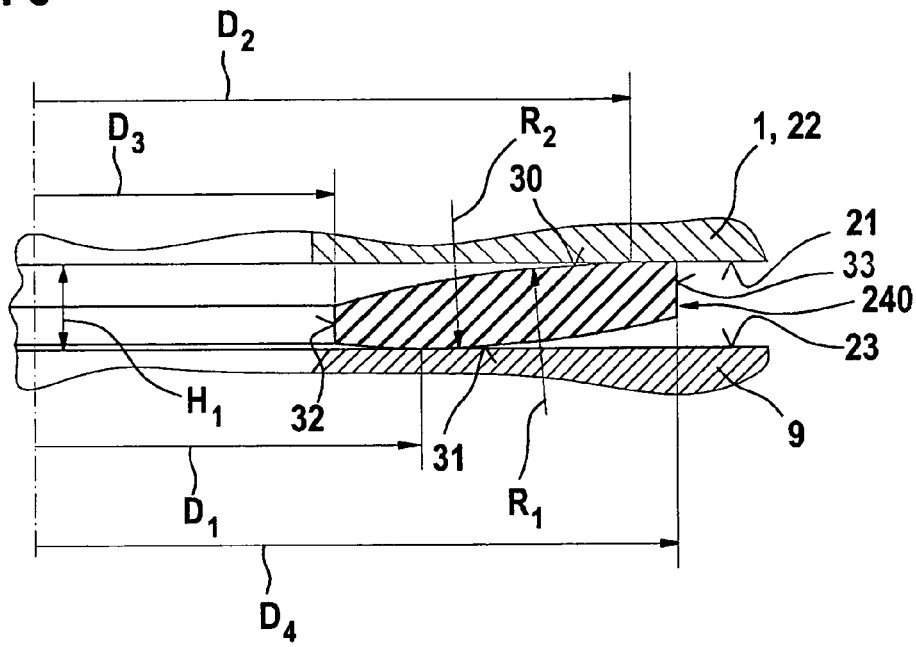
FIG. 6 shows a partial cross section through a second embodiment of a decoupling element according to the present invention and its installation location, which is reversed compared to FIG. 5.

Two exemplary embodiments of decoupling elements 240 are shown in FIGS. 5 and 6, which are distinguished by a lenticular cross-sectional geometry and produce the intended progressive spring characteristic curve due to their specific geometry. The progressive nature of decoupling element 240 may be designed simply via adaptation of a small number of geometric parameters, as are additionally indicated in FIG. 5. The lenticular cross-sectional geometry of decoupling element 240 is selected in such a way that an upper delimitation surface 30 has a convex curve having a first radius $R_1$ and a diametrically opposing lower delimitation surface 31 has a convex curve having a second radius $R_2$. Decoupling element 240 is delimited by perpendicular front faces 32, 33 radially inward and outward, which thus establish internal diameter $D_3$ and external diameter $D_4$ of decoupling element 240 in the non-deformed state. Front faces 32, 33 are not functionally relevant and may thus also deviate from a perpendicular shape. In the non-deformed state, decoupling element 240 has a component height $H_1$.

Upper delimitation surface 30 of decoupling element 240 having first radius $R_1$ presses against a small-diameter area $D_1$ on projection 21 of valve housing 22 of fuel injector 1 in the installed non-deformed state in the fuel injection device, while lower delimitation surface 31 of decoupling element 240 having second radius $R_2$ contacts shoulder 23 of mounting hole 20 in cylinder head 9 in a large-diameter area $D_2$ in the installed state. $D_1$ and $D_2$ are also referred to as contact diameters in the non-deformed state.

The nonlinear, progressive spring characteristic curve of decoupling element 240 is implemented via shortening of the lever arm, which is defined by the radial distance of upper and lower contact points $D_1$ and $D_2$, in increasing load of decoupling element 240. A smaller lever arm causes a higher rigidity of decoupling element 240. The lever arm shortening is achieved by the unrolling of both convex delimitation surfaces 30, 31 of decoupling element 240 on the particular contact partners, i.e., cylinder head 9 and valve housing 22. Both delimitation surfaces 30, 31 are provided in the exemplary embodiment shown in FIG. 5 with a constant radius $R_1$ and $R_2$, both $R_1 = R_2$ and also $R_1 \neq R_2$ being applicable. However, the nonlinear, progressive spring characteristic curve may also be adapted very specifically to the particular application by more complex unrolling geometries, in that different radii are provided on upper delimitation surface 30 and/or on lower delimitation surface 31, so that transitions between various unrolling radii result.

A lever arm shortening by unrolling of decoupling element 240 in the loaded state having a comparable noise-reducing effect is also possible if decoupling element 240 is installed in the fuel injection device in the reverse position. As indicated in FIG. 6, in this case upper delimitation element 30 of decoupling element 240 having first radius $R_1$ presses against projection 21 of valve housing 22 of fuel injector 1 in a large-diameter area $D_1$ in the installed non-deformed state in the fuel injection device, while lower delimitation surface 31 of decoupling element 240 having second radius $R_2$ contacts shoulder 23 of mounting hole 20 in cylinder head 9 in a small-diameter area $D_2$ in the installed state.

For both cases shown in FIGS. 5 and 6, in the non-deformed state of decoupling element 240, the inner contact point is close to internal diameter $D_3$ and the outer contact point is close to external diameter $D_4$ and the inner radial distance between the contact points at $D_1$ and $D_2$ (lever arm length) is greater than the particular outer radial distances from the contact points at $D_1$ or $D_2$ to internal diameter $D_3$ or external diameter $D_4$.

Figure 7:
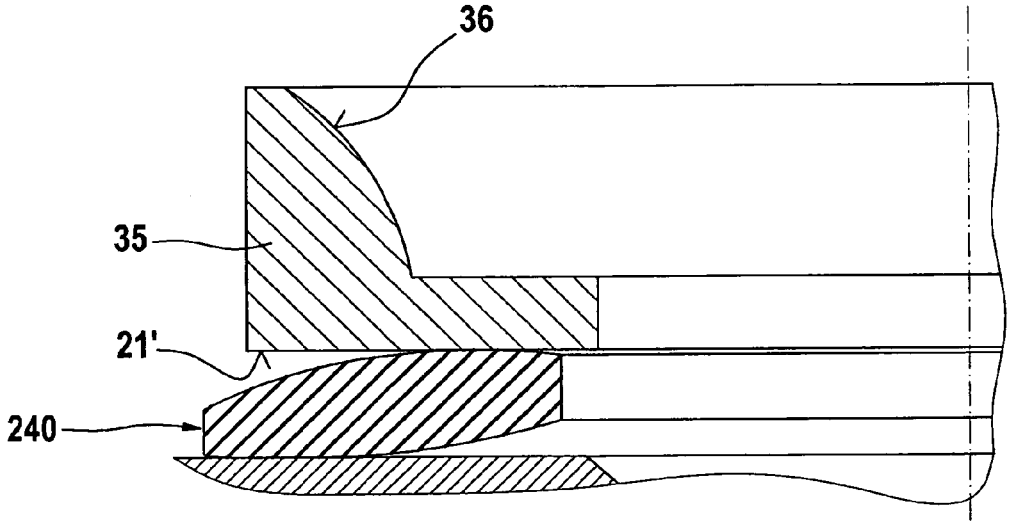
FIG. 7 shows a third embodiment of the decoupling element according to the present invention in a two-part solution together with a support element.

The effect of the lever arm shortening may also be implemented in nonparallel contact surfaces (projection 21, shoulder 23) if, for example, fuel injector 1 and/or mounting hole 20 in cylinder head 9 have walls in the shape of a truncated cone in the area of decoupling element 240 to be introduced. For such an installation situation, for example, a two-part approach is advisable, as shown in FIG. 7. Thus, for example, a support element 35 may be provided, which has a projection 21', which is similar to projection 21 of fuel injector 1, toward decoupling element 240, while support element 35 has a curved contact surface 36 inward toward fuel injector 1, on which fuel injector 1 may be supported with a valve housing 22, which has the shape of a truncated cone. However, the rigidity of additional support element 35 must be taken into consideration in the design of the geometrical parameters of lenticular decoupling element 240.

What is claimed is:

1. A fuel injection device of an internal combustion engine, comprising:

at least one fuel injector having a valve housing;

a mounting hole for the fuel injector; and a decoupling element provided between the valve housing of the fuel injector and a wall of the mounting hole, wherein the decoupling element has a nonlinear, progressive spring characteristic curve to provide a low rigidity during idle operation and a high rigidity during nominal system pressure.

2. The fuel injection device as recited in claim 1, wherein the decoupling element has a disc-shaped design and is lenticular in cross section.

3. The fuel injection device as recited in claim 1, wherein delimitation surfaces of the decoupling element contacting the fuel injector and the wall of the mounting hole are convexly curved.

4. The fuel injection device as recited in claim 3, wherein an upper delimitation surface has a first radius and a diametrically opposing lower delimitation surface has a second radius.

5. The fuel injection device as recited in claim 3, wherein at least one of an upper delimitation surface and a lower delimitation surface has complex unrolling geometries including multiple unrolling radii on the same delimitation surface.

6. The fuel injection device as recited in claim 3, wherein an upper delimitation surface of the decoupling element presses against the valve housing of the fuel injector at a first contact point in a small-diameter area having a first contact diameter in the non-deformed state, and wherein a lower delimitation surface of the decoupling element contacts the mounting hole at a second contact point in a large-diameter area having a second contact diameter.

7. The fuel injection device as recited in claim 6, wherein an inner radial distance between the first contact point and the second contact point is greater than an outer radial distances from one of the first contact point or the second contact point to one of the internal diameter or the external diameter of the decoupling element.

8. The fuel injection device as recited in claim 6, wherein the decoupling element having the nonlinear, progressive spring characteristic curve is configured in such a way that a shortening of a lever arm occurs with increasing load of the decoupling element, the lever arm being defined by a radial distance between the first and second contact points.

9. The fuel injection device as recited in claim 6, wherein at least one of the upper and lower delimitation surfaces of the decoupling element presses against a support element.

10. The fuel injection device as recited in claim 3, wherein an upper delimitation surface of the decoupling element presses against the valve housing of the fuel injector at a first contact point in a large-diameter area having a first contact diameter in the non-deformed state, and wherein a lower delimitation surface of the decoupling element contacts the mounting hole at a second contact point in a small-diameter area having a second contact diameter.

11. The fuel injection device as recited in claim 1, wherein the decoupling element is delimited radially inward and outward by front faces to define an internal diameter and an external diameter of the decoupling element in the non-deformed state.

12. The fuel injection device as recited in claim 1, wherein the mounting hole for the fuel injector is formed in a cylinder head, and wherein the mounting hole has a shoulder extending perpendicular to the extension of the mounting hole, and wherein the decoupling element partially rests on the shoulder.

* * * * *